US011619098B2

(12) United States Patent
Becha

(10) Patent No.: US 11,619,098 B2
(45) Date of Patent: Apr. 4, 2023

(54) DOUBLE ACTING ROTARY AND HAMMERING TOOL

(71) Applicant: SAUDI ARABIAN OIL COMPANY, Dhahran (SA)

(72) Inventor: Belgacem Becha, Khobar (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/404,659

(22) Filed: Aug. 17, 2021

(65) Prior Publication Data

US 2023/0053758 A1 Feb. 23, 2023

(51) Int. Cl.

| | |
|---|---|
| ***E21B 10/32*** | (2006.01) |
| ***E21B 7/30*** | (2006.01) |
| ***E21B 4/02*** | (2006.01) |
| ***E21B 17/05*** | (2006.01) |
| ***E21B 4/00*** | (2006.01) |
| *E21B 17/10* | (2006.01) |

(52) U.S. Cl.

CPC ..... *E21B 7/30* (2013.01); *E21B 4/006* (2013.01); *E21B 4/02* (2013.01); *E21B 10/322* (2013.01); *E21B 17/05* (2013.01); *E21B 17/1014* (2013.01)

(58) Field of Classification Search

CPC . E21B 17/1014; E21B 17/1078; E21B 10/322
See application file for complete search history.

(56) References Cited

U.S. PATENT DOCUMENTS

| | | | | |
|---|---|---|---|---|
| 5,311,953 | A * | 5/1994 | Walker | E21B 17/1014 175/325.1 |
| 6,176,313 | B1 | 1/2001 | Coenen et al. | |
| 6,513,601 | B1 | 2/2003 | Gunnarsson et al. | |
| 6,981,561 | B2 | 1/2006 | Krueger et al. | |
| 8,312,940 | B2 | 11/2012 | Bailey et al. | |
| 8,641,407 | B2 | 2/2014 | Simpson | |
| 8,813,873 | B2 | 8/2014 | Beardmore et al. | |
| 10,161,191 | B2 | 12/2018 | Grable | |
| 2017/0275957 | A1* | 9/2017 | Al Ameri | E21B 17/1014 |

FOREIGN PATENT DOCUMENTS

| | | |
|---|---|---|
| GB | 2418212 A | 3/2006 |
| RU | 2024723 C1 | 12/1994 |

* cited by examiner

*Primary Examiner* — Giovanna Wright
(74) *Attorney, Agent, or Firm* — Osha Bergman Watanabe & Burton LLP

(57) ABSTRACT

A tool for building a wellbore includes a tool body with a flow passage extending axially therethrough, a piston chamber formed radially through the tool body that intersects the flow passage of the tool body, a piston disposed in the piston chamber, at least one actuation element that exerts a force between the piston and the piston chamber, and a sleeve disposed within the flow passage of the tool body that includes at least one cutout. When the sleeve is in a first position within the tool body, the cutout is axially offset from the piston, and when the sleeve is in a second position, the cutout is axially aligned with the piston.

20 Claims, 10 Drawing Sheets

DOUBLE ACTING ROTARY AND HAMMERING TOOL

BACKGROUND

Drilling an oil or gas well includes using a drill string to break down a formation to create and extend the depth of a wellbore. The drill string may have a lower portion, called a bottom hole assembly (BHA), which may include a drill bit, string reamers, directional drilling equipment, and other drilling tools. A specially formulated fluid (known in the art as drilling mud) is continuously circulated through the BHA and into the wellbore to aid in drilling operations and lubricate the BHA. Drilling mud also aids in drilling operations by removing cuttings from the wellbore, controlling formation pressures, and maintaining wellbore stability.

Lost circulation of drilling mud is one of the challenges encountered when drilling a wellbore, and may be the result of naturally fractured formations, improper drilling conditions, or excessive downhole pressure. Due to the time and expense of replacing the drilling mud lost to the formation, lost circulation increases the amount of time and cost to drill the wellbore. In addition, lost circulation may cause an abrupt decrease in the hydrostatic pressure of the wellbore, which may cause the wellbore to collapse. When a wellbore collapses, the drill string may become stuck and potential fishing operations or abandonment of the well may occur.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

This disclosure presents, in one or more embodiments, a tool for building a wellbore that includes a tool body with a flow passage extending axially therethrough, a piston chamber formed radially through the tool body that intersects the flow passage of the tool body, a piston disposed in the piston chamber, at least one actuation element that exerts a force between the piston and the piston chamber, and a sleeve disposed within the flow passage of the tool body that includes at least one cutout. When the sleeve is in a first position within the tool body, the cutout is axially offset from the piston, and when the sleeve is in a second position, the cutout is axially aligned with the piston.

This disclosure also presents, in one or more embodiments, a method of hammering cuttings into a sidewall of a wellbore created by drilling into a formation with a bottom hole assembly. The bottom hole assembly includes a drill bit configured to drill the wellbore and create the cuttings and a double acting tool configured to hammer the cuttings into the sidewall of the wellbore. The double acting tool may include a tool body having a flow passage extending axially therethrough, a piston chamber formed radially through the tool body and intersecting the flow passage of the tool body, a piston assembled to the piston chamber, at least one actuation element provided in the piston assembly, and a sleeve that includes at least one cutout. The sleeve may restrain the piston from being actuated and is disposed in the tool body. The method further includes actuating the sleeve from a first position where the cutout is offset from the piston to a second position where the cutout is aligned with the piston to release the piston into the cutout and hammering the cuttings into the wellbore using the release of the piston while drilling.

This disclosure further presents, in one or more embodiments, a bottom hole assembly attached to a drill string. The bottom hole assembly includes a drill bit positioned at an end of the bottom hole assembly opposite the drill string, a sleeve that includes a plurality of cutouts, and a double acting tool. The double acting tool may include a tool body and a plurality of piston assemblies provided along different axial and circumferential positions around the tool body. Each piston assembly may include a piston retained in a piston chamber and at least one actuation element provided between the piston and the piston chamber. When the sleeve is in a first position around the tool body the cutouts are offset from the piston assemblies and when the sleeve is in a second position around the tool body the cutouts are aligned with the piston assemblies.

Other aspects and advantages will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility.

DETAILED DESCRIPTION

Figure 1:
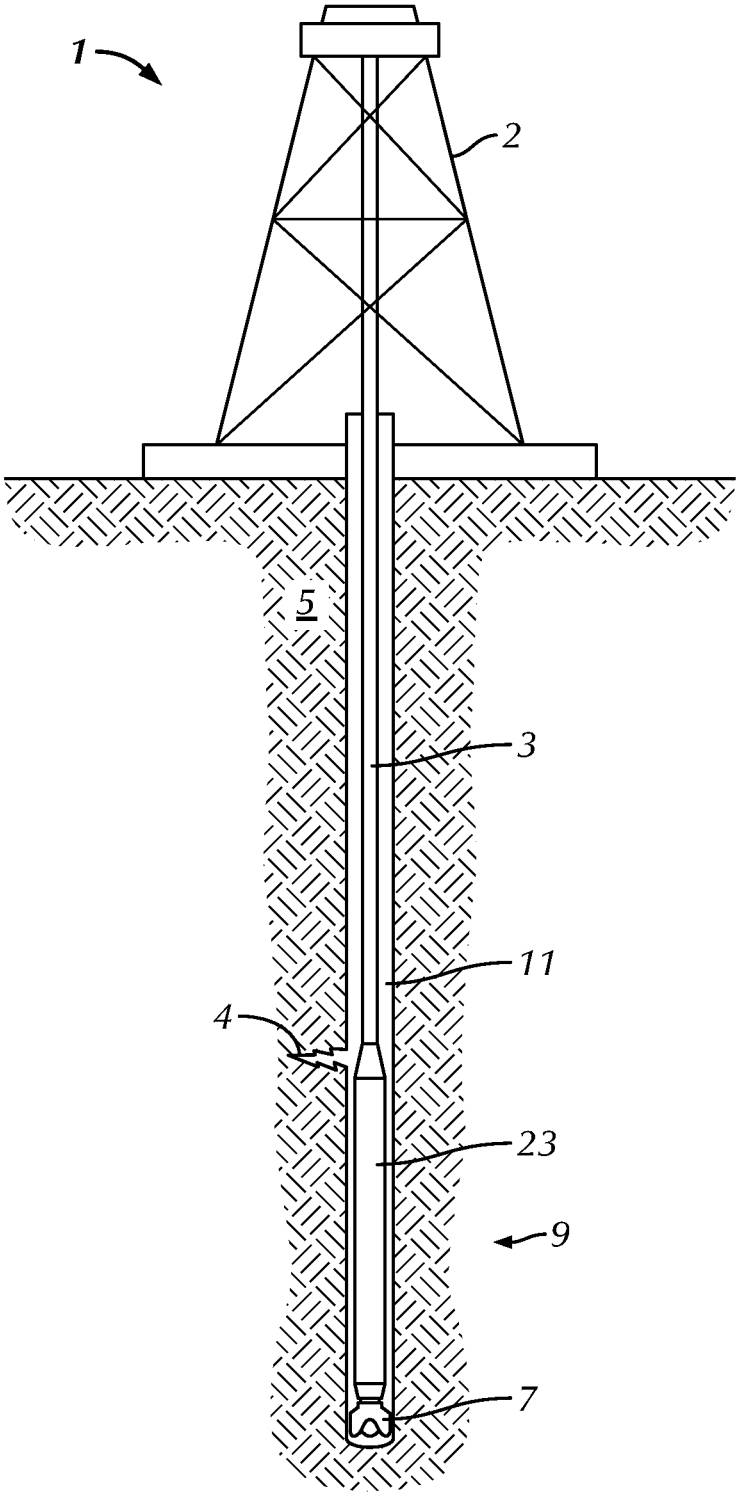
FIG. 1 shows a well site in accordance with one or more embodiments of the present disclosure.

Specific embodiments of the disclosure will now be described in detail with reference to the accompanying figures. In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not intended to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In addition, throughout the application, the terms "upper" and "lower" may be used to describe the position of an element in a well. In this respect, the term "upper" denotes an element disposed closer to the surface of the Earth than a corresponding "lower" element when in a downhole position, while the term "lower" conversely describes an element disposed further away from the surface of the well than a corresponding "upper" element. Likewise, the term "axial" refers to an orientation substantially parallel to the well, while the term "radial" refers to an orientation orthogonal to the well.

In general, one or more embodiments of the disclosure may include a device and a method for drilling in a lost circulation region, e.g., a total-loss region or a partial-loss region, where some or all of the drilling mud used during drilling is lost in the formation. When drilling in a total-loss region, no drilling mud is returned to the surface of the well when drilling, which leads to the height of the fluid column to be reduced, thereby reducing the pressure in the well and potentially leading to a catastrophic loss of well control. When drilling in a partial-loss region, an amount of drilling mud (e.g., greater than about 20 barrels/minute) that significantly affects the drilling operation may be lost in the surrounding formation, but some drilling mud will still return to the surface. Lost circulation may occur, for example, when drilling through a formation having fractures or caverns, which may be naturally occurring or may also occur from the drilling operation. Accordingly, the systems, devices, and methods disclosed herein may be used for the continuation of a drilling operation with a reduced flow rate when drilling in a total or partial loss region.

FIG. 1 shows a schematic diagram illustrating an example of a well site 1. In general, well sites may be configured in a myriad of ways. Therefore, well site 1 is not intended to be limiting with respect to the particular configuration of the drilling equipment. For example, the well site 1 is depicted as being on land, however the well site 1 may be offshore and drilling may be carried out with or without the use of a marine riser.

A drilling operation at the well site 1 may include drilling a borehole into a subterranean formation 5. For the purpose of drilling a new section of well, equipment on a drilling rig 2 may suspend and rotate a drill string 3 within the wellbore 11. The drill string 3 may include a series of connected drill pipes, and a bottom hole assembly 9 (hereinafter "BHA") may be disposed at the downhole end of the drill string 3. The BHA 9 may include a drill bit 7 and a double acting tool 23 according to embodiments of the present disclosure. The drill string 3 may be rotated relative to the wellbore 11, while the weight from the drill string 3 and BHA 9 is applied to the drill bit 7 to enable the drill bit 7 to break the surrounding formation 5 and lengthen the wellbore 11.

While cutting rock with the drill bit 7, drilling mud may be pumped through the drill string 3. The drilling mud may flow down the drill string 3 and exit into the bottom of the wellbore 11 through nozzles in the drill bit 7. The drilling mud in the wellbore 11 may then flow back up to the surface with entrained cuttings in the annular space between the drill string 3 and the wellbore 11. The cuttings may be removed from the drilling mud at the surface of the well, and the drilling mud may be reconditioned before pumping the drilling mud back into the drill string 3.

In total-loss and partial-loss drilling, drilling mud is lost in the surrounding formation 5, where the lost drilling mud cannot be recirculated through the well. For example, when a drill bit 7 drills through a total-loss region 4 in a formation 5, loss of drilling mud return, a drop in bottomhole pressure, and/or other indicators, may indicate, in real time, a total-loss occurrence. In such scenarios, the double acting tool 23 may be activated to hammer cuttings produced from the drill bit 7 into the wellbore 11 wall around the total or partial loss region 4, thereby saving the amount of drilling mud necessary to return the cuttings to the surface. Once the cuttings have been compacted into the wellbore 11, the drilling operation may be resumed to reach the final total casing depth. Therefore, instead of circulating the cuttings to surface, the drilled cuttings may be hammered into the wellbore 11, and at the same time, the amount of water consumption and drilling mud necessary when drilling in a total or partial loss region 4 may be reduced.

Figure 2:
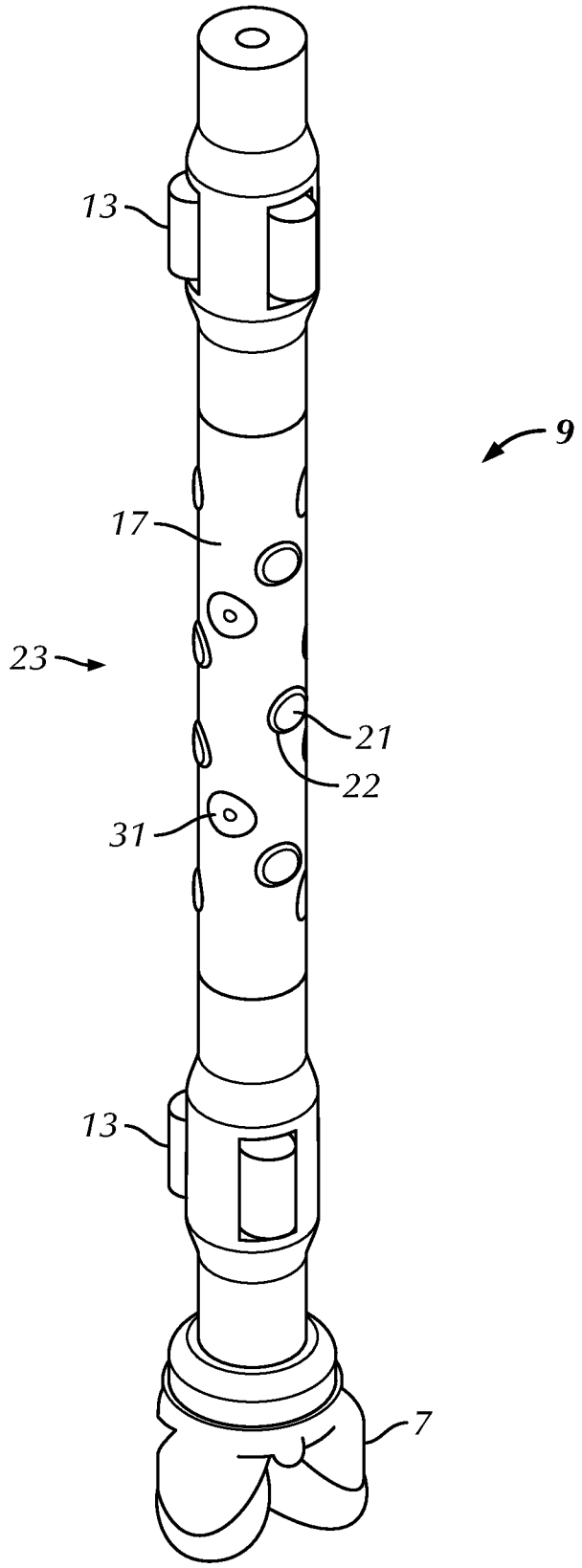
FIG. 2 shows an apparatus in accordance with one or more embodiments of the present disclosure.

FIG. 2 depicts in more detail a BHA 9 in accordance with one or more embodiments of the present disclosure. The BHA 9 may be formed of a plurality of components connected together in an end-to-end fashion, including a drill bit 7 positioned at the lower axial end of the BHA 9. In some embodiments, at least one string reamer 13 may be positioned above the drill bit 7, where the string reamer 13 may enlarge the wellbore 11 and ensure that the wellbore 11 diameter is maintained. In the embodiment shown, the BHA 9 may include two string reamers 13, where each string reamer 13 is attached to opposite axial ends of a double acting tool 23 according to embodiments of the present disclosure. BHAs may include other BHA components that are not shown, such as collars, stabilizers, logging while drilling (LWD) tools, measurement while drilling (MWD) tools, and others.

The double acting tool 23 may have a tool body 17 and one or more piston(s) 21 that are disposed in piston chambers 22 of the tool body 17. The pistons 21 may be made of any rigid material, such as steel, iron, or an alloy, that may withstand and transmit the expected impact force applied by the head 24 of the piston 21 into the wellbore 11. The pistons 21 may be partially retained within piston chambers 22 formed in the tool body 17, such that the pistons 21 may move radially outward from the tool body 17 without falling out of the tool body 17.

As shown in FIG. 2, the pistons 21 are organized in a helical formation such that the pistons 21 are evenly distributed along the tool body 17. However, the pistons 21 may be disposed in any number of different axial and circumferential locations around the tool body 17 such that the drilled cuttings are hammered into the formation 5 when the BHA 9 rotates. Additionally, differing amounts of pistons 21, including one or more pistons 21, may be arranged in different patterns around the tool body 17. Although a single piston 21 may be provided on the double acting tool 23 according to embodiments of the present disclosure, providing multiple additional pistons 21 in additional piston chambers 22 around the tool body 17 may increase the likelihood of hammering more cuttings into a wall of the wellbore 11.

Figure 3:
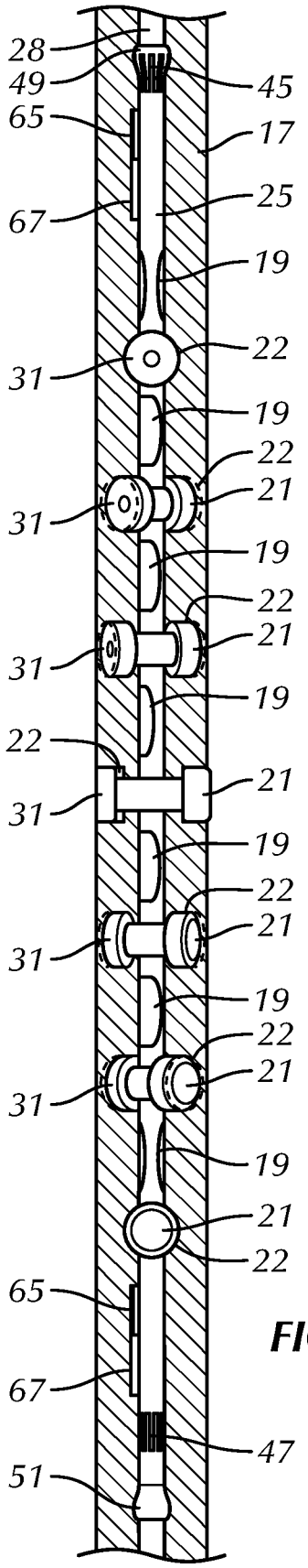
FIG. 3 shows an apparatus in accordance with one or more embodiments of the present disclosure.
Figure 4:
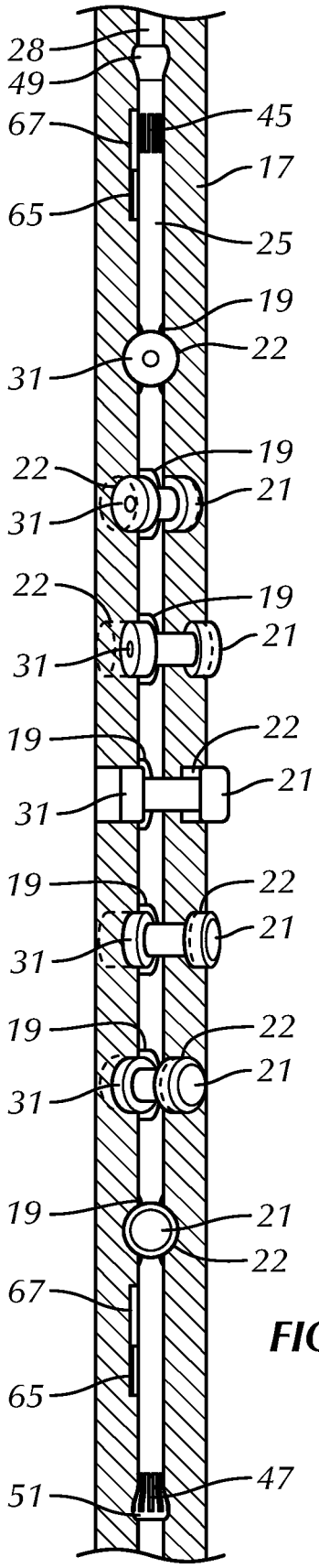
FIG. 4 shows an apparatus in accordance with one or more embodiments of the present disclosure.

Turning to FIGS. 3 and 4, FIGS. 3 and 4 show a cross-sectional view of a double acting tool 23, where the pistons 21 are shown in a retracted position (FIG. 3) and an expanded position (FIG. 4). In order to retain the piston(s) 21 within the tool body 17, a sleeve 25 may be disposed in a flow passage 28 that extends axially through the tool body 17. The sleeve 25 may include upper sleeve fingers 45 formed at an upper axial end of the sleeve 25 and lower sleeve fingers 47 formed at a lower axial end of the sleeve 25. The upper sleeve fingers 45 and lower sleeve fingers 47 may elastically deform to fit within a corresponding upper groove 49 and lower groove 51 of the tool body 17. As shown in FIG. 3, the sleeve 25 may be held in a first position, where the upper sleeve fingers 45 are expanded and fit within the upper groove 49 and the lower sleeve fingers 47 are contracted and positioned above the lower groove 51. The sleeve 25 may be axially moved from the first position to a second position, where the upper sleeve fingers 45 are constrained and positioned below the upper groove 49 while the lower sleeve fingers 47 are expanded and fit within the lower groove 51.

The sleeve 25 may further have at least one cutout 19 that extends radially into the body of the sleeve 25. When the sleeve 25 is in a first position within the tool body 17, such as shown in FIG. 3, the cutouts 19 may be offset from the pistons 21 positioned within the piston chambers 22 of the tool body 17. In the first position, the pistons 21 may be biased against the sleeve 25 so that the sleeve 25 may hold the pistons 21 radially within the tool body 17. Additionally, in the first position shown in FIG. 3, the upper sleeve fingers 45 may be disposed within the upper groove 49, which restricts an axial movement of the sleeve 25 while still allowing the rotational motion of the double acting tool 23. In this position, the lower sleeve fingers 47 may be elastically deformed so as to be biased within the flow passage 28 of the double acting tool 23 above the lower groove 51.

As the sleeve 25 is moved from the first position shown in FIG. 3 to the second position shown in FIG. 4, the upper sleeve fingers 45 may be elastically deformed and withdraw from the upper groove 49. Simultaneously, the lower sleeve fingers 47 may move into the lower groove 51 of the double acting tool 23 and be restored to an undeformed shape. At this point, the cutouts 19 may be aligned with the piston 21, and the pistons 21 may extend into the cutouts 19. When the double acting tool 23 is assembled and configured to hammer a surrounding formation, the pistons 21 may extend into cutouts 19 formed in the sleeve 25 and radially outward from the tool body 17 to hammer cuttings into the formation 5 and build the wellbore 11.

Figure 5A:
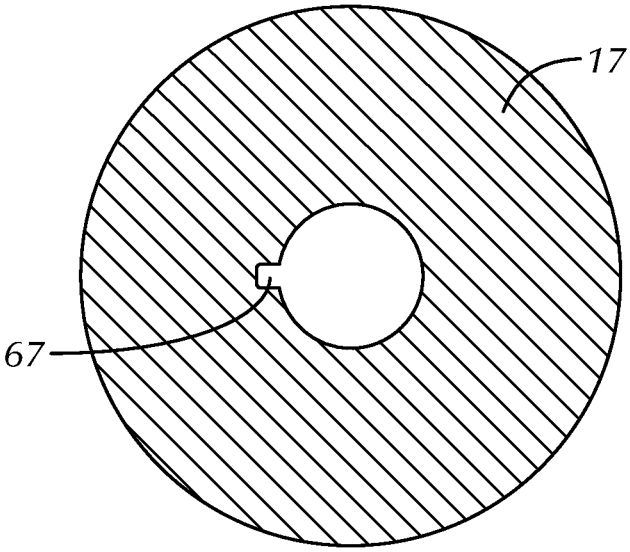
FIGS. 5A and 5B show a locking mechanism for a double acting tool in accordance with one or more embodiments of the present disclosure.
Figure 5B:
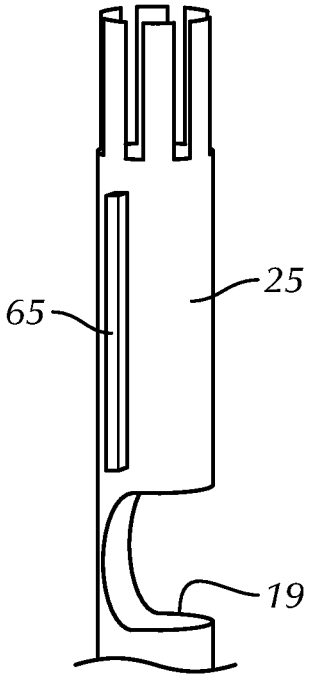

As shown in FIGS. 5A and 5B, in order to prevent the sleeve 25 from rotating within the tool body 17, a locking mechanism may be used between the sleeve 25 and tool body 17. For example, as shown in FIG. 5B the sleeve 25 may further include a locking key 65 embodied as a protrusion of the sleeve 25 extending radially from the surface of the sleeve 25 into a cavity 67 of the tool body 17. As shown in FIG. 5A, the cavity 67 may be an axially extending concavity in the flow passage 28 that extends between the upper groove 49 and the lower groove 51. In addition, the cavity 67 may be configured to retain the locking key 65 of the sleeve 25 such that the sleeve 25 cannot rotate within the flow passage 28 during a movement of the sleeve 25 from the first position to the second position due to the locking key 65.

Continuing with FIGS. 3 and 4, to actuate the sleeve 25 from the first position to the second position, an operator may release a ball (e.g., shown in FIG. 9) into the flow passage 28 of the tool body 17, which is described in more detail below. The ball may move through the flow passage 28 of the tool body 17 until the ball reaches the lower sleeve fingers 47. At this time, the ball may press on the lower sleeve fingers 47, which imparts a downward axial force on the sleeve 25, thereby moving the sleeve 25 to an axial position where the cutouts 19 of the sleeve 25 are aligned with the pistons 21. When the sleeve 25 is in a second position with the cutouts 19 aligned with the pistons 21, as shown in FIG. 4, the pistons 21 may extend into the cutouts 19 and radially outward to hammer cuttings into the wellbore 11.

In order to facilitate the radial extension of a piston 21, the piston 21 may be actuated by an actuation element and may extend and withdraw from a piston chamber 22 formed in the tool body 17, such that the piston 21 extends from being fully disposed within the sleeve 25 to being partially extended out of the sleeve 25, and any number of intermediary positions.

A piston 21 may be mechanically actuated, hydraulically actuated, electrically actuated, or any combination thereof, but each of these embodiments of the piston 21 operate similarly by extending and retracting the piston 21 from the piston chamber 22 of the tool body 17. Additionally, at least one retention mechanism may be used to retain the piston 21 to the tool body 17, such that the piston 21 may extend and retract from the tool body 17 but not fall out of or be removed from the tool body 17.

Figure 6:
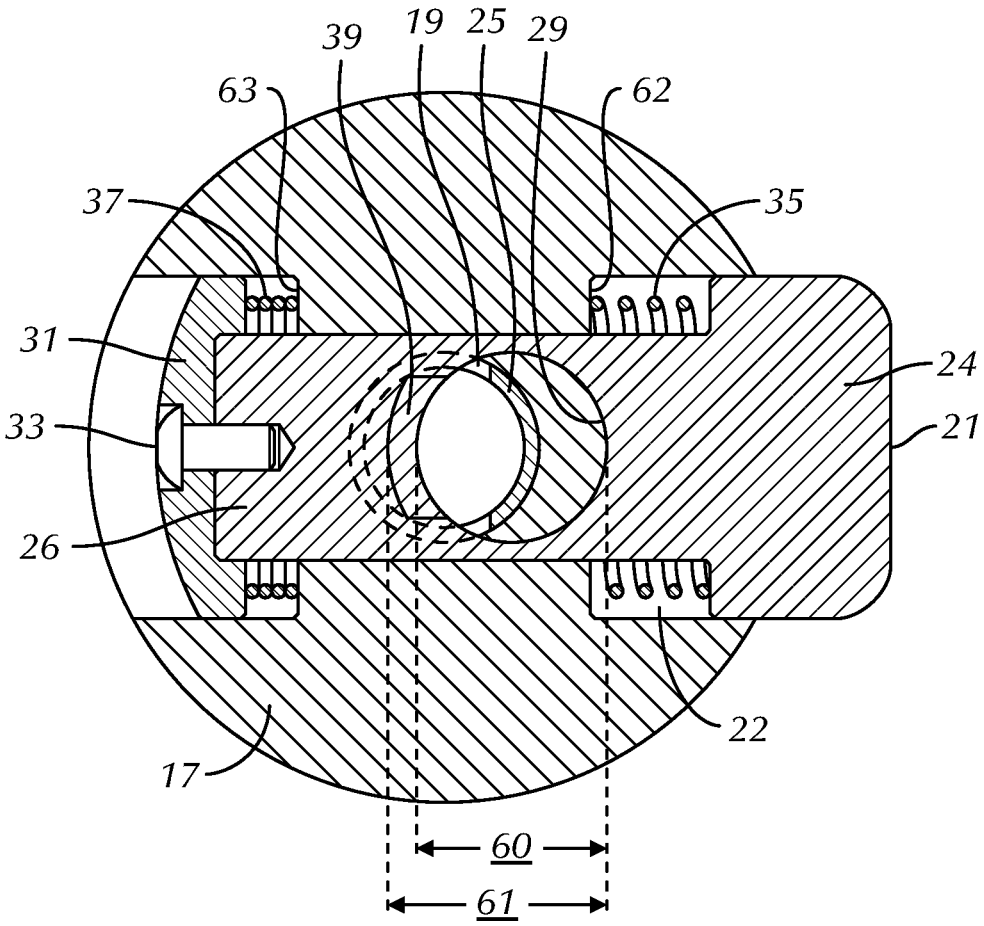
FIG. 6 shows an apparatus in accordance with one or more embodiments of the present disclosure.
Figure 7:
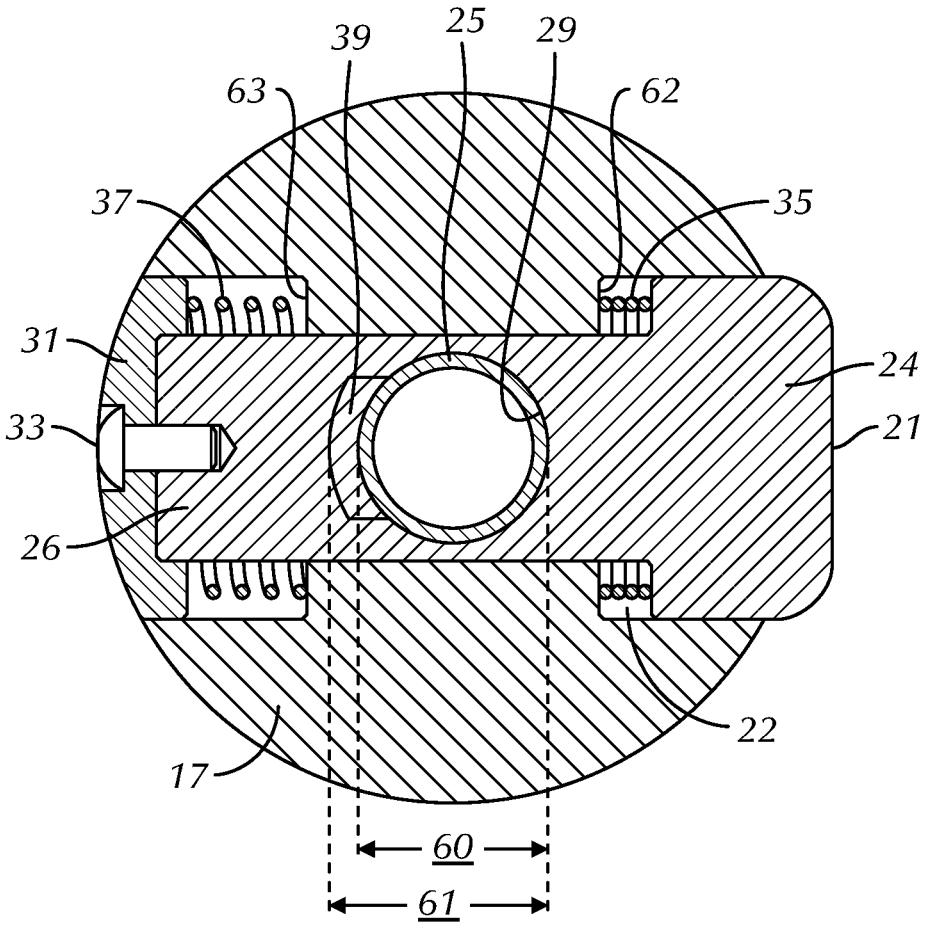
FIG. 7 shows an apparatus in accordance with one or more embodiments of the present disclosure.

For example, FIGS. 6 and 7 show a cross-sectional view (along a plane perpendicular to the axis of the tool body 17) of a piston 21 that is retained to and movable within a piston chamber 22 formed in a tool body 17. In the embodiment shown, the piston 21 may be retained to the piston chamber 22 by a cap 31 and a fastening device 33, where the piston 21 may radially expand (shown in FIG. 6) and retract (shown in FIG. 7) from the tool body 17 according to embodiments of the present disclosure.

The piston 21 may have a piston body with a head 24, a tail 26, and a fluid passage 29 extending through the height of the piston 21, where the fluid passage 29 of the piston 21 may extend parallel to the flow passage 28 of the tool body 17. The piston 21 may be generally cylindrical in shape with the head 24 having a relatively larger diameter than the remaining piston body. However, a person of ordinary skill in the art would appreciate that the piston 21 could have a multitude of shapes and sizes without deviating from the spirit of the invention. For example, the piston 21 may be a rectangular or hexagonal prism in order to hinder the rotation of the piston 21 within the piston chamber 22. As described above, the piston 21 may be made of any rigid material, such as steel, that may withstand and transmit the expected impact force applied by the head 24 to the wellbore 11. In the case of FIG. 6, the impact between the head 24 and the cuttings may create an impact load orthogonal to the exposed surface of the head 24.

An inset 39 may be formed in an upper portion of the fluid passage 29, where the inset 39 may be a slit or recess formed in an upper surface of the fluid passage 29 to form a different geometry in the upper portion of the fluid passage 29. For example, as shown, the fluid passage 29 may have a first inner diameter 60 that is uniform along a first portion of the fluid passage 29 without the inset 39, where the first portion of the fluid passage 29 may be cylindrically shaped. In the inset 39 of the fluid passage 29, the fluid passage 29 may have a second inner diameter 61 greater than the first inner diameter 60 and may have a non-cylindrical geometry.

In order to attach the cap 31 to the tail 26 of the piston 21, the cap 31 may be inserted into the rear opening of the piston chamber 22 and fastened to a tail 26 of the piston 21 by a fastening device 33. In one or more embodiments, the fastening device 33 may be a screw, bolt, or other equivalent fasteners known to one of ordinary skill in the art.

Actuation elements may be provided in the piston chamber 22 to extend and retract the piston 21 in the piston chamber 22. In one or more embodiments, actuation elements may include a first spring 35 disposed proximate to the head 24 of the piston 21 and a second spring 37 disposed proximate to the tail 26 of the piston 21. The first spring 35 may be compressed between the head 24 and the piston chamber 22, while the second spring 37 may be restrained between the cap 31 and the piston chamber 22. For example, in the embodiment shown in FIGS. 6 and 7, the first spring 35 and the second spring 37 may be positioned at opposite sides around the fluid passage 29 of the piston 21 and may facilitate the extension and withdrawal of the piston 21 from the piston chamber 22. The first spring 35 may extend around the circumference of the piston 21 and may be positioned at a first location along the length of the piston 21 between the head 24 and a first ledge 62 of the piston chamber 22. The second spring 37 may extend around the circumference of the piston 21 and may be positioned at a second location (spaced apart from the first location and on an opposite side of the fluid passage 29 of the piston 21 from the first location) along the length of the piston 21 between the cap 31 and a second ledge 63 of the piston chamber 22.

As seen in FIG. 6, the cutout 19 of the sleeve 25 may be aligned with the piston 21 such that the piston 21 may extend into the cutout 19, and the piston head 24 may extend outwardly from the tool body 17. Specifically, the piston 21 may extend into the cutout 19 of the sleeve 25 until the spring force from the second spring 37 prohibits the extension of the piston 21. By using the spring force of the second spring 37 to limit the expansion of the piston 21, a situation in which the piston 21 impacts and damages the sleeve 25 during expansion is advantageously avoided.

In order to assemble the piston 21 into the piston chamber 22 to create a piston assembly, the piston 21 may be inserted into the piston chamber 22 tail end first, with the head 24 being positioned proximate to a front opening of the piston chamber 22 and a tail 26 of the piston 21 being positioned proximate to the rear opening of the piston chamber 22. Prior to the insertion of the piston 21 into the piston chamber 22, the first spring 35 and second spring 37 may be inserted respectively into the front and rear openings of the piston chamber 22. Following the insertion of the piston 21 into the piston chamber 22, the cap 31 may be attached and retain the second spring 37 between the interfacing second ledge 63 and the cap 31. Similarly, the first spring 35 may be retained between the interfacing first ledge 62 and the head 24. After the piston 21 is fully assembled within the piston chamber 22, the sleeve 25 may be inserted into the fluid passage 29 of the piston 21 such that a cutout 19 (e.g., shown in FIGS. 3-5) is offset from the fluid passage 29 of the piston 21, and the piston 21 is retained in a retracted position within the piston chamber 22. Thus, one or more piston assemblies may be formed by assembling the piston 21, the first spring 35, the second spring 37, the cap 31, and the sleeve 25 into the tool body 17.

When the piston 21 extends outwardly from the piston chamber 22, the second spring 37 may compress and apply a compression force to the second ledge 63 of the piston chamber 22, where the cap 31 may retract into the piston chamber 22 in a withdrawn position shown in FIG. 6. Conversely, during a retraction of the piston 21 into the piston chamber 22, as shown in FIG. 7, the first spring 35 may be compressed between the first ledge 62 of the piston chamber 22 and the head 24. The first spring 35 may apply a spring force to the interfacing piston chamber 22 and piston 21 in a direction opposite the compression force from the second spring 37. In addition, the spring force of the first spring 35 may be greater than the spring force of the second spring 37, so that the piston 21 may be biased to extend outwardly from the piston chamber 22 when drilling mud is not flowing through the fluid passage 29 with enough force to overcome the spring force of the first spring 35.

Figure 8:
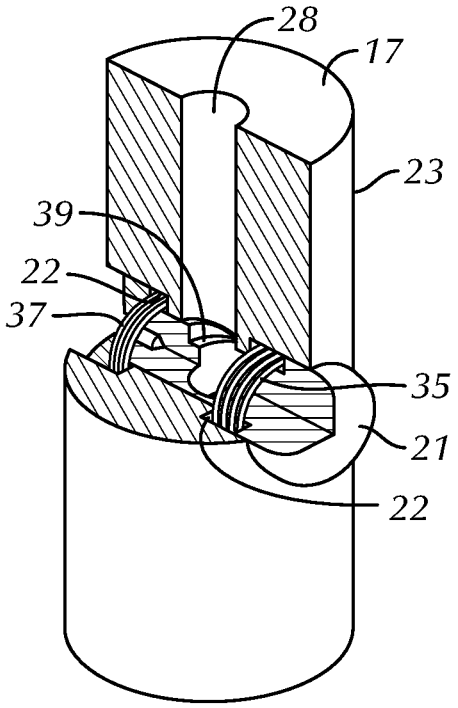
FIG. 8 shows a portion of a double acting tool in accordance with one or more embodiments of the present disclosure.
Figure 9:
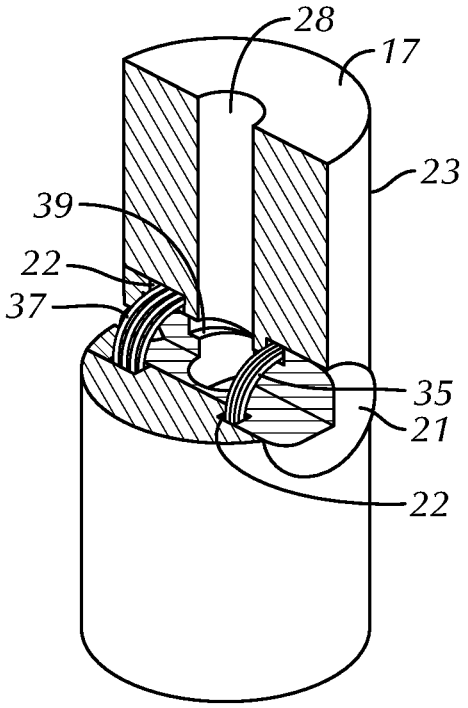
FIG. 9 shows a portion of a double acting tool in accordance with one or more embodiments of the present disclosure.

FIGS. 8 and 9 show a cut-out view of a piston assembly in accordance with one or more embodiments with the piston 21 in extended and retracted positions, respectively, where the sleeve 25 is not shown. In the embodiment depicted in FIG. 8, the piston 21 may be configured to extend due to a force exerted by an actuation element. The extension of the piston 21 from the piston chamber 22 may cause the head 24 of the piston 21 to strike cuttings produced by the drill bit (e.g., drill bit 7 shown in FIG. 1) that are flowing with drilling mud and returning to the surface of the well. The impact force of the piston 21 hammering the cuttings may impregnate the formation (e.g., formation 5 shown in FIG. 1) with the cuttings, thus aggregating the compacted cuttings within the formation without the cuttings being returned to the surface.

As seen in FIGS. 8 and 9, the tool body 17 may have a flow passage 28 extending axially therethrough. The piston chamber 22 may be formed through the diameter of the tool body 17 to intersect the flow passage 28 of the tool body 17. When the piston 21 is assembled in the piston chamber 22 and in a retracted position (as shown in FIG. 9), the fluid passage 29 of the piston 21 may align and be coaxial with the flow passage 28 of the tool body 17. When the piston 21 extends outwardly from the piston chamber 22 (as shown in FIG. 8), the fluid passage 29 in the piston 21 may be radially offset from the flow passage 28 of the tool body 17 (such that the flow passage 29 of the tool body 17 and the fluid passage 29 of the piston 21 are no longer coaxial), and the drilling mud flow path therethrough may be constricted.

As the piston 21 extends outwardly from the piston chamber 22, the increased constriction between the flow passage 28 of the tool body 17 and the fluid passage 29 of the piston 21 may cause the force of the drilling mud on the piston 21 to increase. Due to this constriction, as drilling mud flows through the fluid passage 29 of the piston 21, a portion of the drilling mud may strike the inset 39 and impart a force upon the inset 39. Because the inset 39 is disposed opposite of the first spring 35, the force from the drilling mud on the inset 39 may counteract the force applied by the first spring 35 and add to the spring force of the second spring 37.

Once the combination of force from the second spring 37 and the fluid force from the drilling mud is greater than the spring force of the first spring 35, the piston 21 may begin to retract within the piston chamber 22. When the piston 21 is retracted into the piston chamber 22, the opening formed by the flow passage 28 and the fluid passage 29 of the piston 21 may expand, and the fluid force from the drilling mud on the piston 21 may decrease.

Accordingly, as seen in FIG. 8, when the piston 21 is extended outwardly from the piston chamber 22, the fluid passage 29 of the piston 21 may be offset from the flow passage 28 of the tool body 17, and the second spring 37 may be compressed to a greater degree than the first spring 35. After the piston extension, the piston 21 may then retract back into the piston chamber 22 due to the combination of forces imparted on the piston 21 by the second spring 37 and drilling mud on the inset 39.

Conversely, as seen in FIG. 9, when the piston 21 is retracted within the piston chamber 22, the fluid passage 29 of the piston 21 may be aligned and coaxial with the flow passage 28 of the tool body 17, and the first spring 35 may be compressed to a greater degree than the second spring 37. The spring force of the first spring 35 may be greater than the combination of forces from the second spring 37 and mud flow, resulting in a higher spring force applied to the piston 21 by the first spring 35. Consequently, when a sleeve cutout (e.g., cutout 19 shown in FIGS. 3-5) is aligned with the piston 21 and allows movement of the piston 21 through the sleeve 25, the piston 21 may extend outwardly from the piston chamber 22 due to the greater spring force form the first spring 35, at which point the piston 21 may hammer surrounding cuttings into the wall of the wellbore 11.

Therefore, the piston 21 may be configured to extend and retract from the piston chamber 22 at least in part due to the varying amount of force that the drilling mud may apply to the inset 39 formed in the fluid passage 29. The cap 31 (or a different retaining element) and the varying shape of the piston chamber 22 along its length (e.g., the second ledge 63 of the piston chamber 22) may prevent the piston 21 from moving completely out of the piston chamber 22. The extension distance that the piston 21 may extend outwardly from the tool body 17 may depend on the length of the piston 21, the length of the piston chamber 22, the length of the second spring 37, and the depth of the cap 31, as well as the diameter of the sleeve 25 and the width of the cutout 19.

The extension distance of the piston 21 may be designed based on the outer diameter of the double acting tool 23 and the diameter of the wellbore 11, such that when the piston 21 is extended, the piston 21 may impact the wellbore 11. By way of example, for a tool body 17 diameter of six and a half inches, the piston 21 may be configured to protrude one inch from the tool body 17 when withdrawn and travel two inches during actuation for a total extension length of three inches from the tool body 17. In another example, for tool body 17 diameter of sixteen inches, the piston 21 may be configured to protrude two inches from the body when withdrawn and travel four inches during actuation for a total extension length of six inches. Other extension distances may be designed depending on the sizes of the double acting tool 23, drill bit 7, and wellbore 11, for example, extension distances ranging between 1 and 10 inches, or more.

Figure 10:
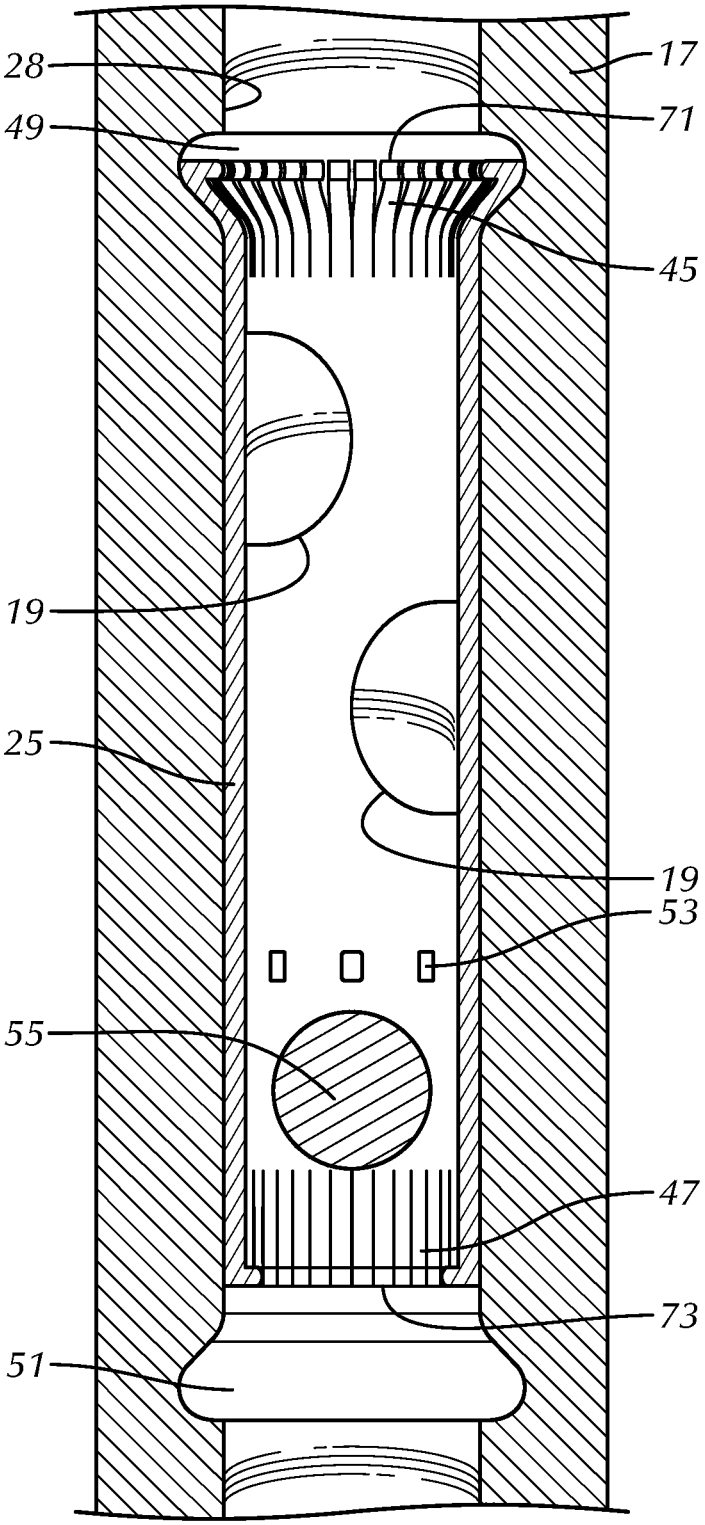
FIG. 10 shows an apparatus in accordance with one or more embodiments of the present disclosure.
Figure 11:
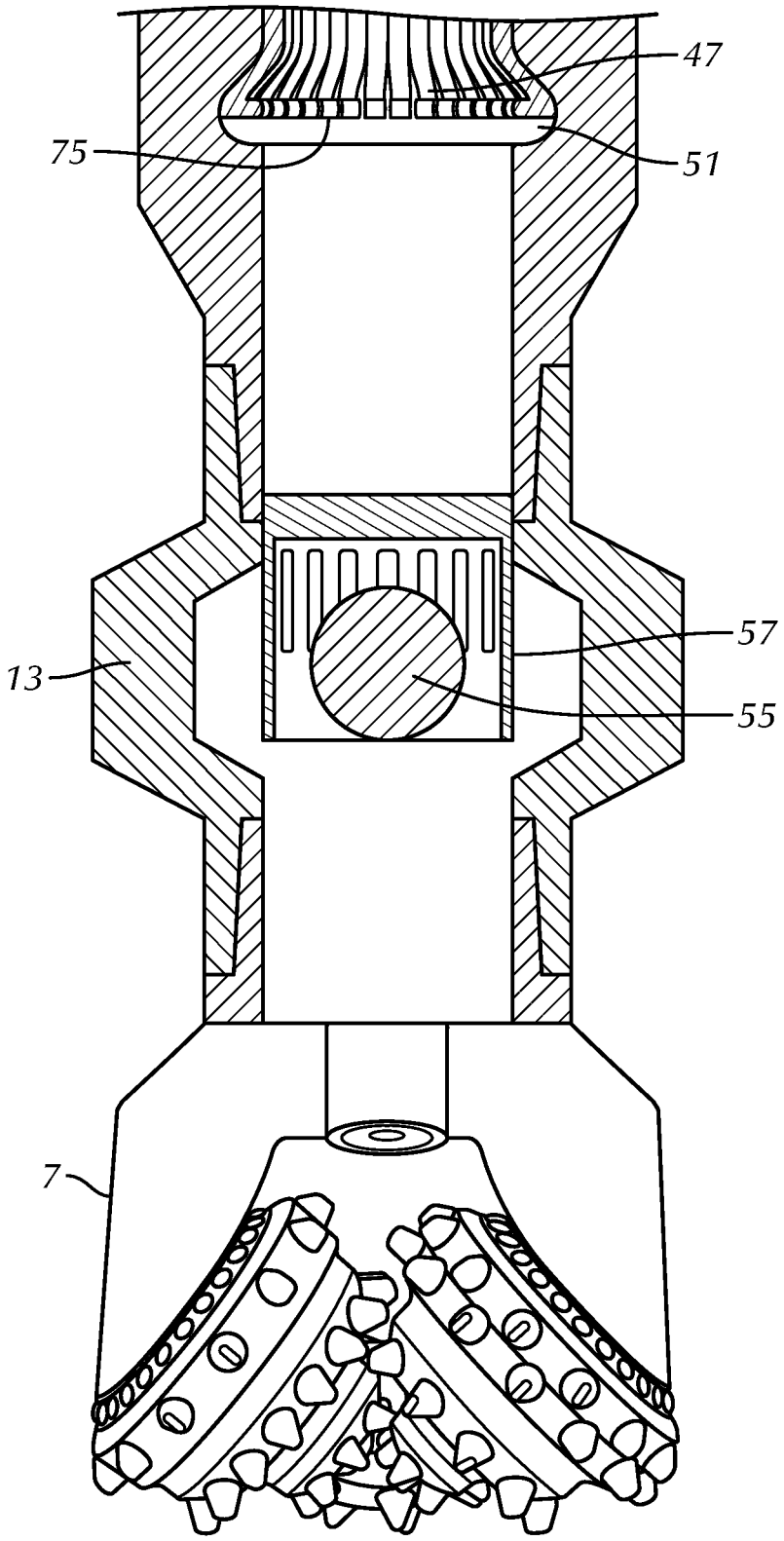
FIG. 11 shows an apparatus in accordance with one or more embodiments of the present disclosure.

Referring now to FIGS. 10 and 11, FIGS. 10 and 11 show steps for activating a double acting tool 23 according to embodiments of the present disclosure by dropping a ball 55 within the double acting tool 23.

FIG. 10 shows an embodiment in which the sleeve 25 may be actuated by a ball 55. When the sleeve 25 is in a first position, the upper sleeve fingers 45 may be disposed in the upper groove 49 and form a first upper opening 71 that has a first diameter larger than the diameter of the ball 55. The lower sleeve fingers 47 may have inwardly facing protrusions formed at the ends of the lower sleeve fingers 47, such that when the lower sleeve fingers 47 are biased against a side wall of the tool body 17 flow passage 28, the finger protrusions may form a stop for the ball 55 with a first lower opening 73 having a lower diameter smaller than the diameter of the ball 55. When the upper sleeve fingers 45 are expanded in the upper groove 49, the ball 55 may freely travel through the first upper opening 71 formed by the upper sleeve fingers 45, the flow passage 28 of the tool body 17, and the fluid passage 29 of the piston 21, until the ball 55 reaches the lower sleeve fingers 47. When the ball 55 reaches the lower sleeve fingers 47, the force of the mud flow on the ball 55 may cause the ball 55 to push downwardly on the lower sleeve fingers 47, thereby pushing the sleeve 25 axially downward until the lower sleeve fingers 47 move to the lower groove 51. When the lower sleeve fingers 47 move into the lower groove 51 (where the sleeve 25 has moved from the first position to the second position) the lower opening created by the lower sleeve fingers 47 may expand outwardly to have a diameter greater than that of the ball 55, thereby forming a second lower opening 3 that allows the ball 55 to fall through the lower sleeve fingers 47.

Following the actuation of the sleeve 25 from the first position to the second position, the upper sleeve fingers 45 may be biased against a side wall of the flow passage 28 and form a second upper opening (e.g., shown in FIG. 4) having a second upper diameter smaller than the diameter of the ball 55.

As shown in FIG. 11, the lower sleeve fingers 47 may be disposed in the lower groove 51, and thereby form a second lower opening 75 having a second lower diameter larger than the diameter of the ball 55. Because the ball 55 may be resting on the lower sleeve fingers 47 in the transition from the first position to the second position, when the lower sleeve fingers 47 expand to form the second lower opening 75 with a diameter larger than the ball 55, the ball 55 may move through the second lower opening 75 and into a ball catcher 57 disposed in the string reamer 13 or other BHA component.

Once the sleeve 25 is actuated to the second position, the sleeve 25 may remain in the second position until an operator retrieves the sleeve 25. For this purpose, the sleeve 25 may have one or more latching holes 53 (shown in FIG. 10) formed on an axial end of the sleeve 25, such that an operator may insert a retrieving tool, such as a hook, into the sleeve 25 and restore the sleeve 25 to the first position. Alternatively, the sleeve 25 may be actuated to either position by a series of springs configured to axially actuate the sleeve 25, or electromagnetically actuated with an electrified coil that surrounds the sleeve 25.

FIG. 11 shows an embodiment of the ball catcher 57 disposed in an axially adjacent component of the BHA (e.g., the string reamer 13). In this embodiment, the ball catcher 57 may be a basket disposed in a passage of the string reamer 13 and on top of the drill bit 7. As such, when the ball 55 moves through the second lower opening 75 formed by the lower sleeve fingers 47, the ball 55 may move with the drilling mud and be received in the ball catcher 57. In this embodiment, the ball catcher 57 has axially oriented slots that allow mud to move out of the ball catcher 57 and into the drill bit 7. However, the ball catcher 57 may be embodied as any perforated design that allows the ball catcher 57 to catch the ball 55 and simultaneously allows fluid to flow to the drill bit 7. By way of example, the ball catcher 57 may alternately be a colander, a net, or any number of suitable elements known to a person of ordinary skill in the art.

Figure 12:
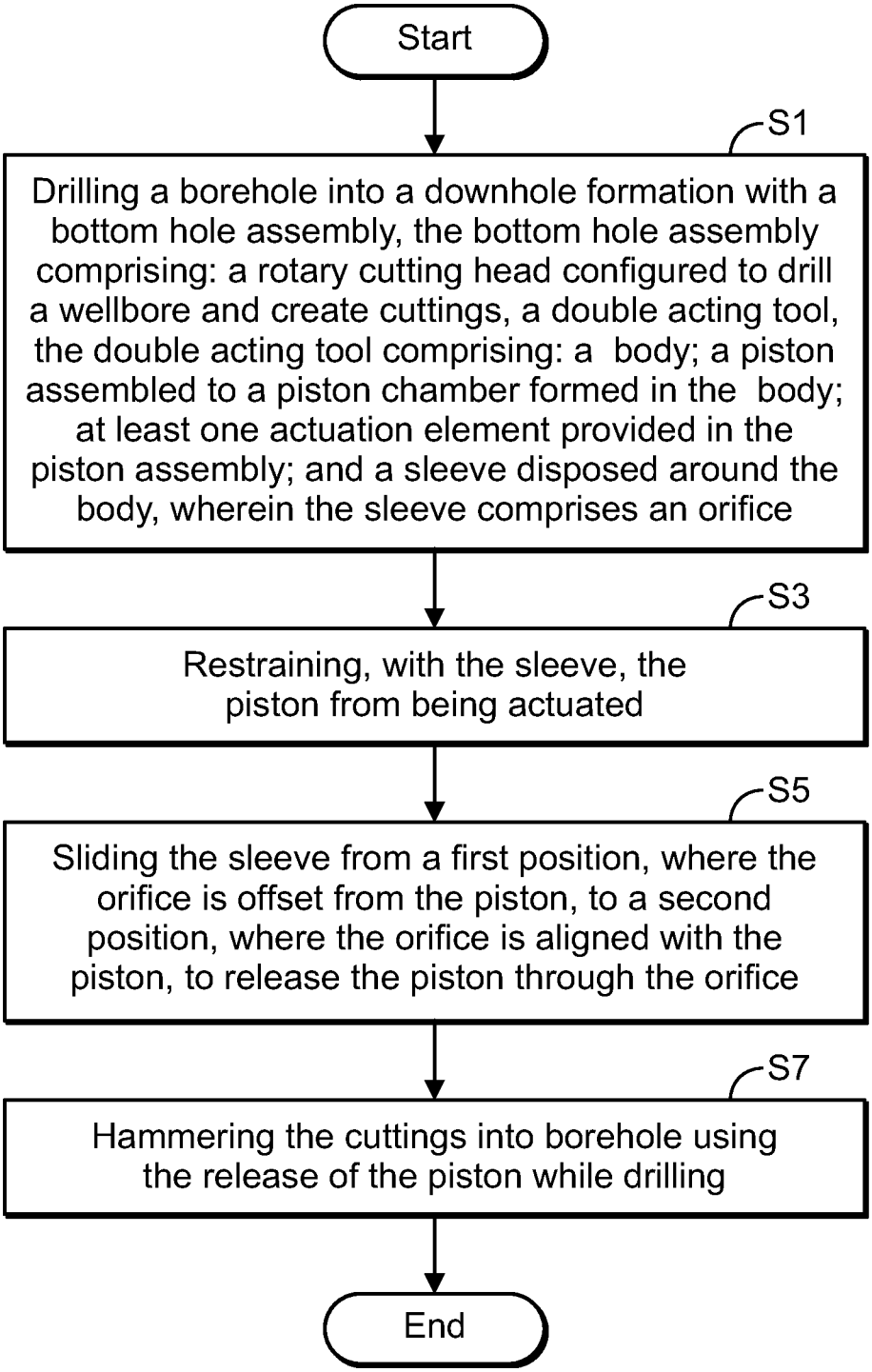
FIG. 12 shows a flowchart of a method in accordance with one or more embodiments of the present disclosure.

FIG. 12 depicts a flowchart in accordance with one or more embodiments. More specifically, FIG. 12 illustrates a method of hammering cuttings into a sidewall of a wellbore 11 using one or more embodiments of the present disclosure, as described above. While the various flowchart blocks in FIG. 12 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

Initially, a wellbore 11 may be drilled with a BHA 9 including a drill bit 7 and a double acting tool 23. As described above, the double acting tool 23 may have a tool body 17, a piston 21 assembled in at least one piston chamber 22 formed in the tool body 17, at least one actuation element (e.g., springs) provided in the piston chamber 22, and a sleeve 25 disposed within the tool body 17 that has at least one cutout 19.

The piston 21 may be restrained by the sleeve 25. Specifically, the sleeve 25 may be in a first position in which a cutout 19 of the sleeve 25 is offset from the piston 21. Due to the force applied to the piston 21 by the actuation element, the piston 21 may be biased against an outer surface of the sleeve 25.

During a time in which total-loss or partial-loss drilling may be suspected, an operator can release a ball 55 into a flow passage 28 of the tool body 17, and the sleeve 25 may then be actuated from a first position in which the cutout 19 may be offset from the piston 21 to a second position in which the cutout 19 may be aligned with the piston 21. Actuating the sleeve 25 from the first position to the second position may involve releasing upper sleeve fingers 45 from an upper groove 49 formed in the tool body 17 and catching lower sleeve fingers 47 in a lower groove 51 formed in the tool body 17. Following the actuation of the sleeve 25 from the first position to the second position, the ball 55 may then be caught in a ball catcher 57.

Because the piston 21 was biased against the outer surface of the sleeve 25 with a spring force in the first position, when the cutout 19 is aligned with the piston 21, the piston 21 may move into the cutout 19 and extend outwardly from the tool body 17 and piston chamber 22. The BHA 9 may continue to rotate, and therefore the double acting tool 23 may also be rotating while the piston 21 is released into the cutout 19.

In order to create a repeated hammering force, drilling mud moving through the tool body 17 may be utilized to apply a fluid force to an inset 39 formed inside the piston 21, where the applied fluid force may retract the piston 21 into the piston chamber 22. The varying force of the mud applied to the inset 39 (which may vary depending on the degree to which the inset 39 interfaces with the drilling mud) may extend and retract the piston 21 into the cutout 19. This allows the piston 21, and thus the double acting tool 23, to hammer the cuttings produced by the drill bit 7 into a side wall of the wellbore 11.

This process may be repeated any number of times if the sleeve 25 is returned to a first position. If the process is to be completed more than once, then the piston 21 may be withdrawn within the piston chamber 22 and a hook or similar tool may be attached to a latching hole 53 of the sleeve 25 in order to return the sleeve 25 to the first position. When the sleeve 25 is returned to the first position, the cutout 19 is offset from the piston chamber 22, and the sleeve 25 may restrain the piston 21 from expanding outwardly.

Accordingly, the aforementioned embodiments as disclosed relate to devices and methods useful to reduce the amount of wasted drilling mud associated with drilling in a total or partial loss region.

As noted above, the lost circulation of drilling mud is a common challenge encountered when drilling a wellbore. Lost circulation of drilling mud may be the result of naturally fractured formations, improper drilling conditions, or excessive downhole pressure. Excessive downhole pressures may induce fractures in the wellbore, which causes drilling mud to be lost to the surrounding formation. While some fluid loss may be expected, total loss can include loss of wellbore control, wellbore instability, stuck equipment, and formation damage due to plugging of pores and pore throats by mud particles. In extreme cases, lost circulation problems may force the abandonment of the well.

The drilling industry has made several advances to prevent lost circulation including the use of lost-circulation materials (LCM) and formation integrity tests (FIT) to diagnose and mitigate potential total loss zones. Conventional methods of sending LCMs to plug a lost circulation zone include designing the fluid parameters to activate or solidify at the predicted time it takes for the chemicals or cement to reach the lost circulation zone. However, activation may sometimes be off, and when activation or solidification happens at a time which differs from the time it takes for the chemicals or cement to reach the lost circulation zone, the LCMs may be lost inside the fractures away from the lost circulation region. In addition, while FITs are useful indications of the strength of the wellbore, FITs may result in a significant loss of drilling time while the test is being performed. Finally, drilling mud that is lost in the lost circulation zone is often unrecoverable, and significant economic and resource waste may occur due to the loss of the drilling mud. Double acting tools disclosed herein may address the challenges from previous techniques of reducing the amount of drilling mud lost in a lost circulation zone by hammering the cuttings into the formation wall as the drilling operation continues.

Although only a few embodiments of the invention have been described in detail above, those skilled in the art will readily appreciate that many modifications are possible in the example embodiments without materially departing from this invention. Accordingly, all such modifications are intended to be included within the scope of this disclosure as defined in the following claims.

The invention claimed is:

1. A tool for building a wellbore, the tool comprising:

a tool body having a flow passage extending axially therethrough;

a piston chamber formed radially through the tool body and intersecting the flow passage of the tool body;

a piston disposed in the piston chamber;

at least one actuation element exerting a force between the piston and the piston chamber; and a sleeve comprising at least one cutout and disposed within the flow passage of the tool body, wherein when the sleeve is in a first position within the tool body, the cutout is axially offset from the piston and the piston is biased against the sleeve, such that the sleeve retains the piston radially within the tool body; and wherein when the sleeve is in a second position, the cutout is axially aligned with the piston and the piston extends into the cutout.

2. The tool of claim 1, wherein the piston comprises:

a fluid passage formed through the piston, wherein the fluid passage is oriented in a direction parallel with the tool body; and an inset formed along an upper surface of the fluid passage.

3. The tool of claim 1, wherein the at least one actuation element comprises:

a first spring, disposed proximate to a head of the piston, and a second spring, disposed proximate to a tail of the piston.

4. The tool of claim 3, wherein the first spring has a spring force greater than the second spring.

5. The tool of claim 1, wherein the sleeve comprises upper sleeve fingers formed at an upper axial end of the sleeve and lower sleeve fingers formed at a lower axial end of the sleeve.

6. The tool of claim 5, wherein, when the sleeve is in the first position, the upper sleeve fingers are disposed in an upper groove formed in the tool body, and wherein, when the sleeve is in the second position, the lower sleeve fingers are disposed in a lower groove formed in the tool body.

7. The tool of claim 1, wherein the sleeve further comprises a latching hole that receives a hook that retrieves the sleeve from the second position.

8. The tool of claim 1, further comprising a locking key configured to prevent the sleeve from rotating within the tool body.

9. The tool of claim 1, further comprising multiple additional pistons assembled in additional piston chambers, wherein the additional piston and piston chamber assemblies are positioned at different axial and circumferential locations around the tool body.

10. A method of hammering cuttings into a sidewall of a wellbore, the method comprising:

drilling into a formation with a bottom hole assembly to create the wellbore, the bottom hole assembly comprising:

a drill bit configured to drill the wellbore and create the cuttings, a double acting tool configured to hammer the cuttings into the sidewall of the wellbore, the double acting tool comprising:

a tool body having a flow passage extending axially therethrough;

a piston chamber formed radially through the tool body and intersecting the flow passage of the tool body;

a piston assembled to the piston chamber formed in the tool body;

at least one actuation element provided in the piston assembly; and a sleeve comprising at least one cutout and disposed in the tool body, wherein the sleeve restrains the piston from being actuated, actuating the sleeve from a first position where the cutout is offset from the piston to a second position where the cutout is aligned with the piston, to release the piston into the cutout; and hammering the cuttings into the wellbore using the release of the piston while drilling.

11. The method of claim 10, further comprising rotating the double acting tool while the piston is released into the cutout.

12. The method of claim 10, wherein actuating the sleeve from the first position to the second position comprises releasing a ball into a fluid passage of the double acting tool to land on lower sleeve fingers of the sleeve and applying pressure to the ball to actuate the ball and the sleeve to the second position, wherein the first position comprises forming, with upper sleeve fingers, a first upper opening having a first upper wellbore larger than a ball diameter, and forming, with the lower sleeve fingers, a first lower opening having a first lower diameter smaller than the ball diameter, and wherein the second position comprises forming, with the upper sleeve fingers, a second upper opening having a second upper diameter smaller than the ball diameter, and forming, with the lower sleeve fingers, a second lower opening having a second lower diameter larger than the ball diameter.

13. The method of claim 12, further comprising catching the ball in a ball catcher disposed below the double acting tool.

14. The method of claim 10, wherein actuating the sleeve from the first position to the second position comprises releasing upper sleeve fingers of the sleeve from an upper groove formed in the tool body of the double acting tool and catching lower sleeve fingers of the sleeve into a lower groove formed in the tool body of the double acting tool.

15. The method of claim 10, wherein the at least one actuation element comprises a first spring positioned proximate a head of the piston and a second spring positioned proximate a tail of the piston, the method further comprising applying a first force to the piston in a first direction via the first spring and applying a second force to the piston in a second direction via the second spring, wherein the second direction is opposite the first direction.

16. The method of claim 15, further comprising utilizing a fluid flow to apply a third force to an inset of the piston in the second direction, thereby retracting the piston.

17. The method of claim 10, further comprising attaching a hook to the sleeve to actuate the sleeve from the second position to the first position.

18. The method of claim 10, wherein assembling the piston to the piston chamber comprises:

inserting the piston into the piston chamber, wherein a head of the piston is positioned proximate a front opening of the piston chamber and a tail of the piston is positioned proximate a rear opening of the piston chamber; and attaching a cap to the tail of the piston through the rear opening of the piston chamber.

19. The method of claim 18, wherein the at least one actuation element comprises a first spring and a second spring, the method further comprising:

inserting the first spring into the front opening of the piston chamber prior to inserting the piston, wherein the first spring is disposed between the piston chamber and the head of the piston; and inserting the second spring through the rear opening of the piston chamber prior to attaching the cap, wherein the second spring is disposed between the piston chamber and the cap.

20. A bottom hole assembly attached to a drill string, the bottom hole assembly comprising:

a drill bit positioned at an end of the bottom hole assembly opposite the drill string; and a double acting tool, the double acting tool comprising:

a tool body having a flow passage extending axially therethrough;

a plurality of piston assemblies provided along different axial and circumferential positions around the tool body, each piston assembly comprising:

a piston retained in a piston chamber, wherein the piston has a fluid passage extending through the piston and in parallel with the flow passage; and at least one actuation element provided between the piston and the piston chamber; and a sleeve comprising a plurality of cutouts, wherein, when the sleeve is in a first position around the tool body, the cutouts are offset from the piston assemblies and the fluid passage of each piston is coaxial with the flow passage of the tool body, and wherein, when the sleeve is in a second position around the tool body, the cutouts are aligned with the piston assemblies and the fluid passage of each piston is radially offset with the flow passage of the tool body.

* * * * *